United States Patent [19]

Watanabe et al.

[11] 4,342,605

[45] Aug. 3, 1982

[54] GAS SOFT-NITRIDING METHOD

[75] Inventors: Teruoki Watanabe, Kawagoe; Shunji Kobayashi, Sayama, both of Japan

[73] Assignee: Honda Giken Kogyo Kabushiki Kaisha, Tokyo, Japan

[21] Appl. No.: 225,980

[22] Filed: Jan. 19, 1981

Related U.S. Application Data

[63] Continuation of Ser. No. 54,696, Jul. 5, 1979, abandoned.

[51] Int. Cl.[3] ..... C21D 1/48

[52] U.S. Cl. ..... 148/16.6; 148/16.5

[58] Field of Search ..... 148/16, 16.5, 16.6, 148/20.3

[56] References Cited

U.S. PATENT DOCUMENTS

| | | | |
|---|---|---|---|
| 3,748,195 | 7/1973 | Kondo et al. | 148/16.6 |
| 4,003,764 | 1/1977 | Wunning | 148/16.5 |
| 4,035,203 | 7/1977 | L'Hemite et al. | 148/16.6 |
| 4,049,472 | 9/1977 | Arndt | 148/16.6 |
| 4,163,680 | 8/1979 | Syrchikov et al. | 148/16.5 |

FOREIGN PATENT DOCUMENTS

| | | |
|---|---|---|
| 49-17328 | 2/1974 | Japan . |
| 49-74639 | 7/1974 | Japan . |
| 52-105542 | 9/1977 | Japan . |

*Primary Examiner*—John P. Sheehan

*Attorney, Agent, or Firm*—Irving M. Weiner; John L. Shortley; Pamela S. Burt

[57] ABSTRACT

A gas soft-nitriding method which comprises a step of subjecting iron parts to a gas soft-nitriding treatment in a heat treating furnace at a temperature of approximately 550° C.–620° C. in a mixed atmosphere which comprises, when introduced into the furnace, 10%–30% ammonia gas, 2.5%–4.5% total carbon monoxide, and a balance of $N_2$ gas or an exothermic gas on a volume basis. Thereby, the iron parts are provided with superior fatigue and wear resistance qualities, while production costs and the cost of the treated parts are substantially reduced.

8 Claims, 2 Drawing Figures

GAS SOFT-NITRIDING METHOD

This is a continuation of application Ser. No. 54,696 filed July 5, 1979 abandoned.

BACKGROUND OF THE INVENTION

1. Field of the Invention

The present invention relates to an improved method for the gas soft-nitriding treatment of iron parts by employing a carrier gas containing a major proportion of nitrogen gas.

2. Description of Relevant Art

In general, iron members to be used as parts for machine construction are required to have superior fatigue and wear resistance qualities. In order to satisfy such requirements, there are known methods in which iron parts are nitrided to form a hard layer composed of a nitride compound in the surface portion of the iron parts, imparting the required characteristics to the parts. Typical of such methods are: a known gas nitriding method; a salt bath nitriding method; and the like. However, such methods have a number of attendant disadvantages and shortcomings.

For example, the known gas nitriding method requires an undesirably prolonged treating time, and presents a problem with regard to fatigue resistance because the parts treated by the method become relatively fragile, though showing high hardness due to formation of a deep hardened layer. Accordingly, such method is unfavorable if the parts require an excellent fatigue resistance quality with a degree of hardness.

The salt bath nitriding method is advantageous in that the treatment is feasible at low temperature with a shorter treating time and that the resultant parts are relatively high in hardness and fatigue resistance, and are thus favorably usable as iron machine construction parts which should have high fatigue resistance. In contrast to the above advantages, however, the salt bath nitriding method requires use of cyanides or cyanates which are highly toxic, presenting problems such as environmental pollution, and inconvenience and danger in handling, etc.

In recent years, there have been developed, proposed, and put into practice gas soft-nitriding methods in which iron parts are nitempered under relatively safe conditions using a gaseous medium containing nitrogen gas to improve the fatigue strength and wear resistance of the parts. These gas soft-nitriding methods ensure similar treating results as the salt bath nitriding method, with the advantage that the problem of environmental pollution is substantially alleviated.

Such gas soft-nitriding method entails formation in the surface portion of iron parts a layer of crystalline structure called an $\epsilon$ phase composed of iron, nitrogen and carbon (Fe-N-C). Known carrier gases useful in the gas soft-nitriding treatment have the following compositions.

(1) Combination of ammonia gas and an endothermic gas (RX gas)

$NH_3$ gas: 50%

RX gas: 50%

($NH_3$ 50%, CO 12.5%, $H_2$ 15.6%, $CO_2$ 0.13%, and the remainder $N_2$, such percentages, as well as those presented hereinbelow, being by volume).

(2) Combination of ammonia gas and methanol-cracked gas $NH_3$ gas: 50%

Methanol-cracked gas: 50%

($NH_3$ 50%, CO 16.7%, $H_2$ 3.3%, $CO_2$ 0.2%, and the remainder $N_2$).

(3) Combination of ammonia gas and an exothermic gas (NX gas)

$NH_3$ gas: 20%

NX gas: 80%

($NH_3$ 20%, CO 1.4%, $H_2$ 0.7%, $CO_2$ 0.04%, and the remainder $N_2$).

Known gas soft-nitriding methods using the above set forth carrier gases have the following disadvantages. With the methods using the carrier gases (1) and (2), ammonia gas which is relatively expensive is used in large quantities (40%–60% by volume), increasing the production cost and the cost of the treated parts. Further, the CO gas is employed in excessive amounts, so that the content of carbon in the resulting compound layer becomes high and thus the hardness of the layer becomes too high due to the large content of carbon. Consequently, the layer tends to be hard and fragile. Particularly, with long parts which are required to be corrected in strain after the treatment, there is a strong likelihood of producing cracks. In addition, the treated parts are deposited with carbon on the surface thereof, and must be washed in an additional step after the treatment.

In the case of using the carrier gas (3) above, the CO content is so small that formation of the $\epsilon$ phase is not ensured, resulting in poor fatigue strength.

An explanation as to why such problems are encountered in such known methods is set forth hereinbelow.

The fundamental principle on which the gas soft-nitriding method is based is the formation of a Fe-N-C layer of $\epsilon$ phase in the surface portion of iron parts by diffusing the nitrogen [N] and carbon [C] from the surface of the parts into the interior thereof according to the following reactions:

$$NH_3 \rightleftarrows [N] + 3/2H_2 \quad \text{(a)}$$

$$2CO \rightleftarrows [C] + CO_2 \quad \text{(b)}.$$

It is important to note that the nitriding treatment should be conducted by use of a gas composition which is capable of producing optimum potentials of [N] and [C].

On the basis of the reaction formula (a), the potential of [N] can be expressed as follows:

$$a[N] = P_{NH3}/[P_{H2}]^{3/2} \cdot K_N \quad (a_1).$$

The potential of [C] on the basis of the reaction formula (b) can be expressed as follows:

$$a[C] = [P_{CO}]^2/P_{CO2} \cdot K_C \quad (b_1).$$

The activities of nitrogen [N] and carbon [C] are determined based on the equations ($a_1$) and ($b_1$). In the above equations, $K_N$ and $K_C$ represent equilibrium constants of the reaction formulae (a) and (b), respectively.

In a gas soft-nitriding method using 40%–60% of ammonia gas and correspondingly 60%–40% of an endothermic gas (RX gas), the nitriding treatment is not possible unless the ammonia gas is used in a large amount in order to keep the activity of [N] and the value of [N] constant because of a high content of $H_2$ in the endothermic gas. Use of expensive ammonia gas in such large amount results in an increase of production costs, and a corresponding increase of the cost of treated parts.

In a gas soft-nitriding method using 10%–30% of ammonia gas and correspondingly 90%–70% of an exothermic gas (NX gas), the CO content in the mixed gas is very small, so that it is almost impossible to keep the activity of [C] in the above equation ($b_1$) at a satisfactory level. Thus, this method is disadvantageous as compared with the method using ammonia gas and the endothermic gas in that the treated parts are more susceptible to fatigue when undergoing stress concentration during application as machine construction components.

The present invention effectively solves the foregoing problems inherently found in conventional gas soft-nitriding methods, i.e., cost problems due to a high consumption of expensive ammonia gas, and problems of a poor resistance to fatigue of the treated parts and deposition of carbon on the treated surface of the parts. As described in the known methods (1)–(3) using large quantities of ammonia gas, it has been found that the content of CO gas has a great influence on the hardness, resistance to fatigue, and wear of parts treated by the gas soft-nitriding method.

SUMMARY OF THE INVENTION

The present invention provides a gas soft-nitriding method which comprises a step of heating iron parts in a heat treating furnace at a temperature of approximately 550° C.–620° C. in a controlled gas which when introduced into the furnace comprises, on a volume basis, 10%–30% of ammonia gas, 2.5%–4.5% of total carbon monoxide (CO), and the remainder substantially comprising $N_2$. The total carbon monoxide may be free carbon monoxide added in an amount of 2.5%–4.5% by volume of the controlled gas. Alternatively, an endothermic gas containing carbon monoxide may be added in such a manner that the content of the carbon monoxide component in the endothermic gas is in the above-defined range. As a further alternative, the total carbon monoxide may be composed of 1%–3% by volume of free carbon monoxide and a balance of a carbon monoxide component derived from an exothermic gas containing a major proportion of $N_2$. In the last case, such free carbon monoxide may be replaced by an endothermic gas so that the carbon monoxide component from the endothermic gas is contained in an amount of 1%–3% by volume of the controlled gas.

It is accordingly an object of the present invention to provide an improved gas soft-nitriding method in which ammonia gas which is used in large quantities in the conventional methods is employed in a relatively small quantity, with a reduction of production costs of the gas soft-nitriding treatment and an improvement in economy of the gas soft-nitriding treatment. Thus, the cost of the treated parts is reduced as compared with those obtained by the conventional known methods.

It is another object of the invention to provide a gas soft-nitriding method which can impart to treated parts resistances to fatigue and wear which are similar to or higher than those attained by known methods, and is thus very useful and advantageous in economy due to a reduced consumption of ammonia gas.

A further object of the invention is to provide a gas soft-nitriding method which is free of carbon deposition on the surfaces of the treated parts, to thus provide a clean treated surface.

A still further object of the invention is to provide a gas soft-nitriding method using a carrier gas which employs a very reduced amount of ammonia gas as compared with the amount employed in known methods, and which contains a suitable amount of carbon monoxide.

The above and further objects, advantages, and features of the present invention will become apparent from the following detailed description of preferred embodiments when read in conjunction with the accompanying drawings.

DETAILED DESCRIPTION OF PREFERRED EMBODIMENTS

Figure 1:
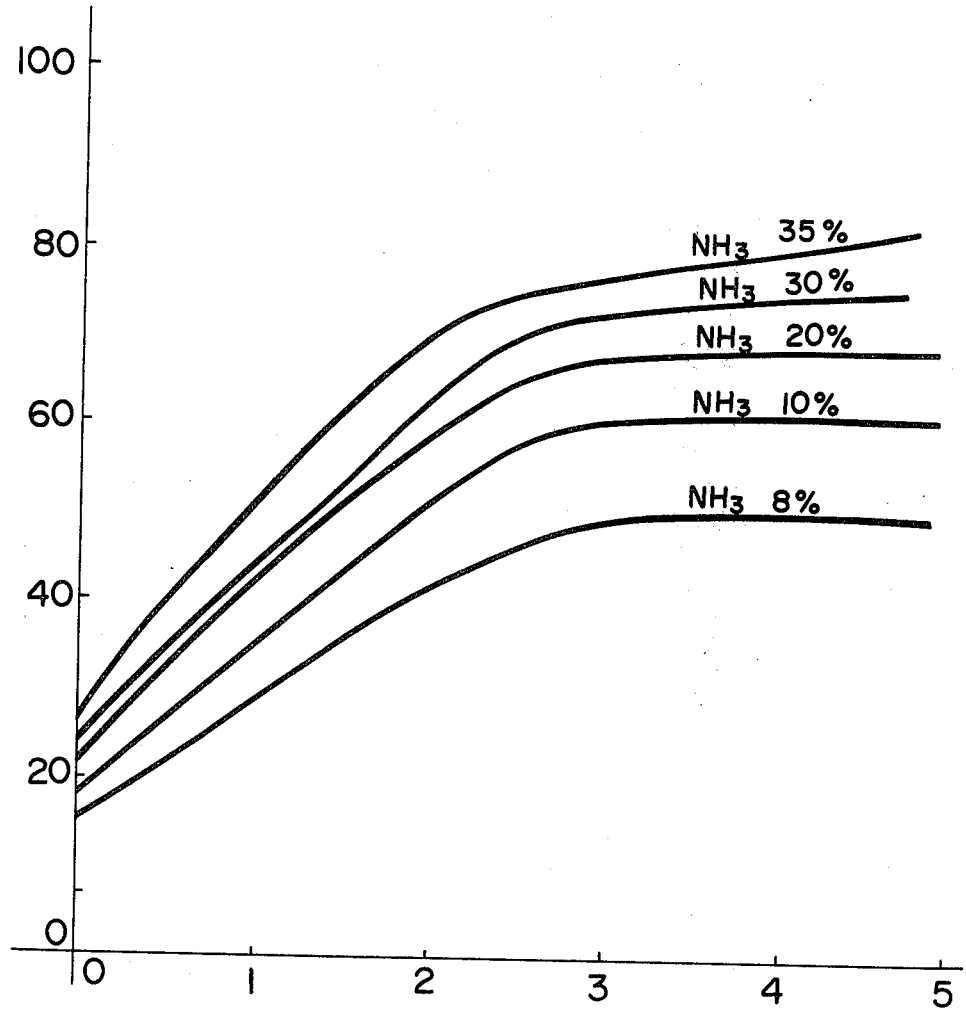
FIG. 1 is a graphical representation of a relation between a content of carbon monoxide and an X-ray intensity ratio of phase.

In the present inventive method, the gas soft-nitriding treatment is conducted by introducing into a heat treating furnace a controlled gas which when introduced is substantially composed, on a volume basis, of 10%–30% ammonia gas ($NH_3$), 2.5%–4.5% total carbon monoxide (CO), and a substantial percentage of $N_2$ gas, i.e., a balance of $N_2$ gas; or 10%–30% ammonia gas ($NH_3$), 1%–3% free carbon monoxide, and a balance of an exothermic gas. It is to be noted that the total amount of carbon monoxide should be in the range of 2.5%–4.5%, regardless of whether it is free carbon monoxide or a combination of free carbon monoxide and a carbon monoxide component contained in a mixed gas such as an exothermic gas, endothermic gas or methanol cracked gas.

The carrier gas (gas soft-nitriding controlled gas) useful for the gas soft-nitriding treatment of the invention is formulated as follows:

(A)

Ammonia gas ($NH_3$): 10%–30% by volume;
Carbon monoxide (CO): 2.5%–4.5%;
$N_2$ gas: balance.

(B)

Ammonia gas ($NH_3$): 10%–30% by volume;
Carbon monoxide (CO): 1%–3%;
Exothermic gas (NX gas): balance.

The controlled gas in the above formulation is charged into a heat treating furnace, in which atmosphere the gas soft-nitriding treatment is conducted at temperatures of 550° C.–620° C.

As described with regard to the above set forth known methods (1)–(3), the amount of ammonia gas greatly depends on the amount of CO. In the controlled gas to be used in the present invention, the amount of ammonia gas is reduced to 10%–30%, but the amount of CO is increased to such a level that a satisfactory fatigue resistance is obtained while free carbon is prevented from being deposited on the surfaces of the treated parts.

$N_2$ or an exothermic gas (NX gas) is used as a carrier gas. By decreasing the amount of hydrogen ($H_2$) in a gas mixed with ammonia gas ($NH_3$), the ammonia gas ($NH_3$) is thus decreased. In such case, the amount of CO is so small as to create difficulty in forming an $\epsilon$ phase, so that carbon monoxide (CO) is forced into the carrier gas with the ammonia gas being reduced in quantity.

The composition of the exothermic gas (NX gas) is set forth below together with a commonly-employed endothermic gas composition (RX gas).

Exothermic Gas (NX gas)

CO: 1.8%
$H_2$: 0.9%
$CO_2$: 0.05%
$N_2$: balance.

Endothermic Gas (RX gas)

CO: 24.5%
$H_2$: 31.2%
$CO_2$: 0.26%
$H_2O$: 0.4%
$N_2$: balance.

For the introduction of carbon monoxide (CO), free carbon monoxide may be used; or either an endothermic gas or a methanol cracked gas which is rich in CO component may be used. It is important that ammonia gas, CO, and $N_2$ or an exothermic gas be mixed in suitable ratios so that the potentials of N and C required for the formation of the $\epsilon$ phase are controlled at constant levels.

The present invention will be more particularly described by way of the following examples.

EXAMPLE I

A cold rolled steel (SPCC prescribed in Japanese Industrial Standard with a composition of below 0.12% C, below 0.5% Mn, below 0.04% P, below 0.045% S, and a balance of Fe) was heated in an atmosphere which, when introduced into the furnace, comprised 20% $NH_3$, 2.5% CO, and the balance $N_2$ gas, at 600° C. for one hour.

As a result of the surface X-ray diffraction of the thus treated steel, it was revealed that the X-ray intensity ratio of the $\epsilon$ phase was as high as 64%, which is a favorable result.

EXAMPLE II

Example I was repeated without the use of CO gas, with the result that the treated steel had an X-ray intensity ratio of $\epsilon$ phase of 21% with the remaining being composed of $\gamma$ and $\alpha$ phases, and was thus not practical for use.

Further, the above procedure was repeated using different amounts of CO and $NH_3$ with the results shown in FIG. 1. As shown in FIG. 1, a suitable X-ray intensity ratio (i.e., above approximately 60%) cannot be obtained unless CO is used in an amount of above 2.5% and $NH_3$ in an amount of above 10%. It has been found that when CO and $NH_3$ exceed 4.5% and 30%, respectively, the surface hardness becomes higher than required, tending to produce cracks when the treated member is required to correct the strain thereof. In addition, no deposition of carbon was observed when the CO content was below 4.5%. Use of CO and $NH_3$ in unnecessarily increased amounts is not favorable because of an increase of production costs. In FIG. 1, the amount (percentage by volume) of carbon monoxide (CO) is taken as the abscissa, and the X-ray intensity ratio (percentage) of $\epsilon$ phase as the ordinate.

EXAMPLE III

Test pieces of a cold rolled steel (S48C prescribed in Japanese Industrial Standard with a composition of 0.45–0.51% C, 0.15–0.35% Si, 0.6–0.9% Mn, below 0.03% P, below 0.035% S, and a balance of Fe) was heated at 600° C. for two hours in an atmosphere which, when introduced into the furnace, comprised 15% $NH_3$, 11% of an endothermic gas (RX gas), and the balance $N_2$ gas. The endothermic gas employed had a composition of 24.5% CO, 31.2% $H_2$, 0.26% $CO_2$, 0.4% $H_2O$, and the balance $N_2$, and the amount of CO was within the afore-defined range.

Figure 2:
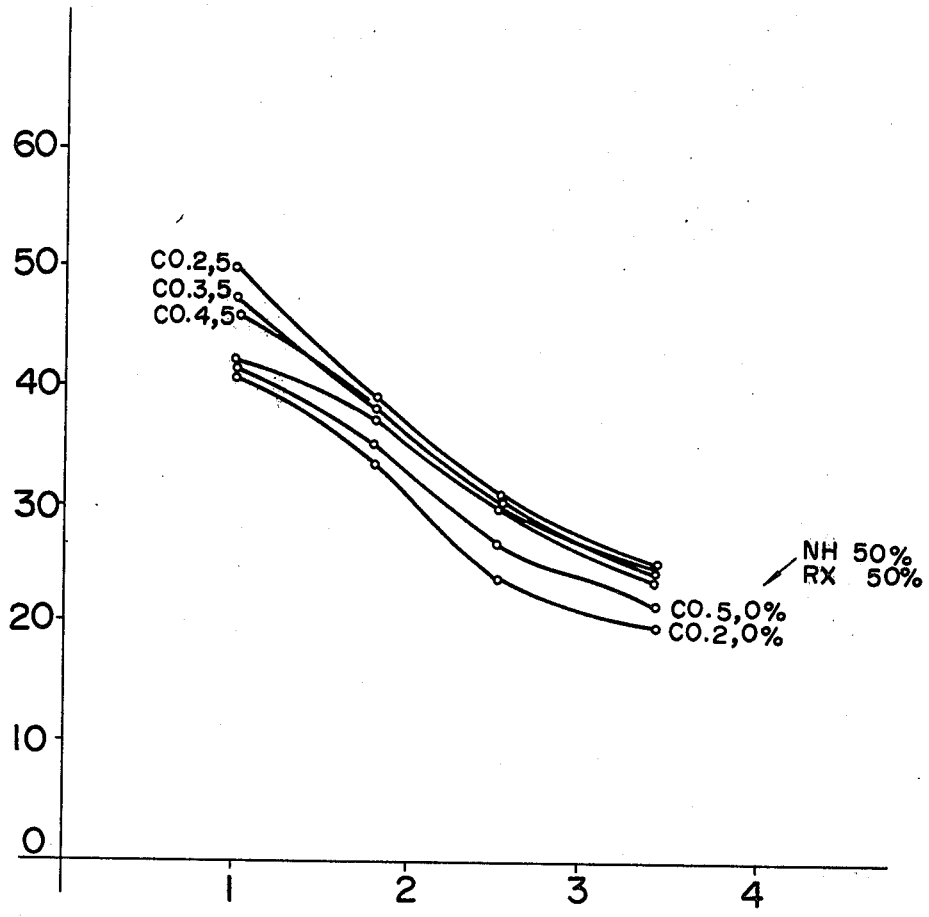
FIG. 2 is a graphical representation of a relation between a form coefficient and a fatigue limit of parts treated according to a known method and the present inventive method, for purposes of comparison.

The thus treated pieces were subjected to the "Ono" rotary bending fatigue test, with the results shown in FIG. 2. The fatigue limits were found to be 50 kg/mm$^2$, 35.5 kg/mm$^2$, and 25.1 kg/mm$^2$ when the form coefficients were 1.0, 2.1 and 3.4, respectively. These results were better than those obtained by a known method (using 50% RX gas and 50% $NH_3$ gas).

The Ono rotary bending fatigue test is employed to determine a rotary bending fatigue limit of a metal material in the form of a standard test piece, while repeating the rotary bending operation above $10^4$ times at room temperature in air. Such "rotary bending" refers to the rotation, relative to a bending moment, of a test piece having an axis within a plane of the bending moment, by which repeated stresses are exerted on the test piece to determine the fatigue limit thereof. The test device is constructed of a rotary shaft for rotating the standard test piece, a drive motor for the shaft, and a load mechanism having a metal fitting suspended from a ball bearing mounted in an inner end portion of a beam of the rotary shaft, and a coil spring.

When the procedure of Example III was repeated using varying amounts (%) of CO, it was found that the content of CO should be in the range of 2.5%–4.5% in order to attain the same fatigue limit as in the case of known conventional methods.

With reference to FIG. 2, the form coefficient is taken as the abscissa and the fatigue limit (kg/mm$^2$) as the ordinate.

In the foregoing examples, controlled gases using ammonia gas, carbon monoxide (CO) or CO-rich RX gas, and $N_2$ gas in mixed form are set forth, however, similar results are obtained when a controlled gas is employed which comprises ammonia gas, carbon monoxide (CO), or CO component-rich RX gas, and instead of $N_2$ gas, an NX gas (exothermic gas) containing a major proportion of $N_2$. In such case, CO gas is added in an amount of 1%–3% because the NX gas contains a certain amount of CO and the total amount of CO gas may sufficiently be in the range of 2.5%–4.5%.

As will be understood from the foregoing, according to the invention, the amount of ammonia gas in the controlled gas is reduced from 40%–60%, as essentially employed in the known methods, to only 10%–30%. Instead, carbon monoxide is incorporated in a carrier gas, by which treated parts are imparted with fatigue and wear resistance similar to or superior to those attained by the known methods. Thus, the present invention has a number of advantages such as a considerable reduction in the costly consumption of expensive ammonia, a reduction in production cost for the gas soft-nitriding treatment, and an economical gas soft-nitriding treatment with similar or more pronounced results than those attained by the known methods, including a reduced cost of the treated parts.

Although there have been described what are at present considered to be the preferred embodiments of the invention, it will be understood that various modifications may be made therein, and the present invention may be embodied in other specific forms without departing from the spirit or essential characteristics thereof. The present embodiments are therefore to be considered in all respects as illustrative, and not restrictive. The scope of the invention is indicated by the appended claims rather than by the foregoing description.

We claim:

1. A gas soft-nitriding method for a ferrous workpiece, comprising the step of:

heating said ferrous workpiece to a temperature of 550° C.–620° C. in a furnace into which a gas atmosphere is introduced to produce an $\epsilon$-phase soft-nitrided layer on said ferrous workpiece; and wherein a gas atmosphere comprising a 10–30 volume percentage of ammonia ($NH_3$), a 2.5–4.5 volume percentage of carbon monoxide (CO), and a substantial volume percentage of nitrogen ($N_2$) is initially introduced into said furnace.

2. A gas soft-nitriding method according to claim 1, wherein:

said 2.5–4.5 volume percentage of carbon monoxide is composed of free carbon monoxide.

3. A gas soft-nitriding method according to claim 1, wherein:

said carbon monoxide is derived from a carbon monoxide-containing endothermic gas.

4. A gas soft-nitriding method according to claim 1, wherein:

said 2.5–4.5 volume percentage of carbon monoxide is composed of 1–3 volume percentage of free carbon monoxide relative to said controlled gas and a balance of carbon monoxide component derived from an exothermic gas containing nitrogen.

5. A gas soft-nitriding method according to claim 4, wherein:

said free carbon monoxide is replaced by an endothermic gas so that the carbon monoxide component in said endothermic gas is at the same level as said free carbon monoxide.

6. A gas soft-nitriding method according to claim 1, wherein:

said volume percentage of carbon monoxide is obtained by introducing an endothermic gas which substantially comprises, in volume percentage:

24.5% carbon monoxide (CO);
31.2% hydrogen ($H_2$);
0.26% carbon dioxide ($CO_2$);
0.4% water ($H_2O$); and
56.36% nitrogen ($N_2$).

7. A gas soft-nitriding method according to claim 1, wherein:

said volume percentage of carbon monoxide is obtained by introducing a carbon monoxide gas in a 1–3 volume percentage and an exothermic gas which substantially comprises, in volume percentage:

1.8% carbon monoxide (CO);
0.9% hydrogen ($H_2$);
0.05% carbon dioxide ($CO_2$); and
97.25% nitrogen ($N_2$).

8. A gas soft-nitriding method according to claim 7, wherein:

said 1–3 volume percentage of carbon monoxide is obtained by introducing an endothermic gas which substantially comprises, in volume percentage:

24.5% carbon monoxide (CO);
31.2% hydrogen ($H_2$);
0.26% carbon dioxide ($CO_2$);
0.4% water ($H_2O$); and
56.36% nitrogen ($N_2$).

* * * * *